US011000898B2

(12) United States Patent
Roessler et al.

(10) Patent No.: US 11,000,898 B2
(45) Date of Patent: May 11, 2021

(54) METHOD FOR THE SURFACE COMPACTION AND CALIBRATION OF A SINTERED COMPONENT

(71) Applicant: Miba Sinter Austria GmbH, Laakirchen (AT)

(72) Inventors: Horst Roessler, Krenglbach (AT); Herbert Schmid, Vorchdorf (AT); Manuel Steinmaurer, Steinerkirchen (AT); Karl Dickinger, Vorchdorf (AT)

(73) Assignee: Miba Sinter Austria GmbH, Laakirchen (AT)

( * ) Notice: Subject to any disclaimer, the term of this patent is extended or adjusted under 35 U.S.C. 154(b) by 728 days.

(21) Appl. No.: 15/366,339

(22) Filed: Dec. 1, 2016

(65) Prior Publication Data

US 2017/0165755 A1 Jun. 15, 2017

(30) Foreign Application Priority Data

Dec. 14, 2015 (AT) ..... A 51059/2015

(51) Int. Cl.
*B22F 3/16* (2006.01)
*B22F 3/10* (2006.01)

(52) U.S. Cl.
CPC ..... *B22F 3/164* (2013.01); *B22F 3/1017* (2013.01); *B22F 2003/166* (2013.01)

(58) Field of Classification Search
CPC ..... B22F 3/164; B22F 2003/166
See application file for complete search history.

(56) References Cited

U.S. PATENT DOCUMENTS 5,631,029 A * 5/1997 Bewlay ..... B22F 3/03 425/405.2
5,694,640 A 12/1997 Greetham
6,168,754 B1 * 1/2001 Woolf ..... B22F 3/03 29/893.34

(Continued)

FOREIGN PATENT DOCUMENTS

AT 504 081 A1 3/2008
AT 507 913 A1 9/2010

(Continued)

*Primary Examiner* — Anthony J Zimmer
*Assistant Examiner* — Jeremy C Jones
(74) *Attorney, Agent, or Firm* — Collard & Roe, P.C.

(57) ABSTRACT

According to a method for the surface compaction and calibration of a sintered component, the sintered component runs along an axis through a plurality of die sections of a die, the inner diameter of which decreases in pressing direction and wherein the individual die sections are arranged such that a following die section of the plurality of die sections directly adjoins the corresponding die section which precedes it in pressing direction, and after the surface compaction at the last die section with decreasing inner diameter there is a relaxation of the sintered component in a relief section directly adjoining the last die section, which relief section has a greater diameter than the immediately preceding last die section of the die section with a decreasing inner diameter. The sintered component is calibrated in the relief section, whereby the inner contour of the relief section corresponds with the intended contour with the nominal dimensions of the sintered component.

6 Claims, 4 Drawing Sheets

(56) References Cited

U.S. PATENT DOCUMENTS

| | | | | |
|---|---|---|---|---|
| 8,474,295 | B2 | 7/2013 | Schmid et al. | |
| 2002/0044985 | A1 | 4/2002 | Nordell et al. | |
| 2003/0143096 | A1* | 7/2003 | Shimizu | C25D 5/48 419/9 |
| 2006/0039638 | A1* | 2/2006 | Takizawa | F16C 33/104 384/279 |
| 2010/0098575 | A1* | 4/2010 | Schoegl | B21H 5/022 419/28 |
| 2011/0132057 | A1* | 6/2011 | Schmid | B22F 3/03 72/352 |
| 2013/0129558 | A1* | 5/2013 | Dumanski | B22F 3/03 419/66 |
| 2013/0266681 | A1* | 10/2013 | Cripps | B22F 3/03 425/234 |
| 2014/0020442 | A1 | 1/2014 | Menendez-Castanedo et al. | |
| 2017/0341130 | A1* | 11/2017 | Nakai | B22F 3/164 |

FOREIGN PATENT DOCUMENTS

| | | | |
|---|---|---|---|
| CN | 103260788 | A | 8/2013 |
| CN | 103909261 | A | 7/2014 |
| EP | 2 066 468 | B1 | 6/2014 |
| JP | H10-85995 | A | 4/1998 |
| RU | 2 156 179 | C2 | 9/2000 |

* cited by examiner

METHOD FOR THE SURFACE COMPACTION AND CALIBRATION OF A SINTERED COMPONENT

CROSS REFERENCE TO RELATED APPLICATIONS

Applicant claims priority under 35 U.S.C. § 119 of Austrian Application No. A 51059/2015 filed on Dec. 14, 2015, the disclosure of which is incorporated by reference.

The invention relates to a method for the surface compaction and calibration of a sintered component, according to which the sintered component is moved along an axis from a first die opening in the direction of a second die opening of a die opposite the first die opening along the axis, wherein during this movement the sintered component runs through a plurality of die sections of the die and in this way a surface area of the sintered component is compacted, whereby in pressing direction an inner diameter of the consecutive die sections decreases and the individual die sections are arranged such that a respective following die section of the plurality of die sections directly adjoins the corresponding die section which precedes it in pressing direction, and after the surface compaction at the last die section with decreasing inner diameter there is a relaxation of the sintered component in a relief section directly adjoining the last die section, which relief section has a greater diameter than the immediately preceding last die section of the die section with a decreasing inner diameter.

Sintered components, i.e. workpieces made from pressed and sintered metal powder have long been an alternative to cast workpieces or workpieces worked from a solid form. The higher or lower porosity of the sintered components determined by the production method has a negative effect on the mechanical properties of a sintered component, whereby the use of powder-metallurgically produced components is restricted.

To reduce the surface porosity various different methods are known from the prior art. For example, rotationally symmetrical sintered components are often roiled.

From JP 10 085 995 A an method is known for compacting a sintered component by using a die. The die comprises a plurality of die sections, which adjoin one another directly, wherein in the pressing direction of the sintered component through the die the inner diameter of the die sections decreases.

A similar method is known from RU 2 156 179 C2.

From EP 2 066 468 A2 a method is known for the surface compaction of a sintered component, in which the sintered component is moved in a die along an axis in a pressing direction through a plurality of die sections from a first die section on a first die opening to a last die section, wherein a wall surface of each die section forms at least one pressing surface, against which a contact surface formed by an outer surface of the sintered component is pressed, and an inner contour, which lies in a cross-section relative to the axis and is defined by the pressing surface, corresponds at least approximately to an outer contour defined by the contact surface. During the movement of the sintered component from the first die opening to the last die section the surface compaction is performed through die sections which merge into one another and monotonically decreasing inner diameters of the die sections measured between the cooperating pressing surfaces.

In the method according to the latter EP-A2 if necessary a calibration of the sintered component can also take place after the surface compaction. For this purpose after the last die section an adjoining calibrating section is provided which has a calibrating diameter which corresponds to an intended diameter of the sintered component on its outer surface. The calibrating section can thereby directly adjoin the last die section, i.e. the second, lower die opening, or also be provided with an intermediate space between the last die section and the dimensionally accurate calibrating section, whereby prior to the calibration an interim relief of the sintered component is possible. It is also described in the latter that the calibrating section comprises a calibrating plate adjoining the second, opposite die surface. The calibration of the sintered component can either be performed immediately after the last surface compaction or by interconnecting a relief section. The relief section directly adjoins the second die opening.

The objective of the invention is to provide a simplified method for the surface compaction of a sintered component.

The objective of the invention is achieved by the aforementioned method in which the sintered component is calibrated in the relief section, whereby the inner contour of said relief section corresponds to the intended contour with the nominal dimension of the sintered component.

It is an advantage here that prior to the calibration there is no further deformation of the sintered component from the relieved state, whereby the formation of a ridge on the sintered component caused by the kneading effect during surface compaction can be reduced. Furthermore, in this way also the die is loaded mechanically to a lesser degree, as a further compaction of the sintered component from the relieved state requires greater deforming forces, after the latter has already been surface compacted further in the preceding compaction stages. By combining the calibrating section with the relief section in addition the duration of the surface compaction method and calibration of the sintered component can be shortened.

According to a preferred embodiment variant of the method it is possible to use a die, in which the relief section is formed. Preferably, a one-piece die is used for both the surface compaction and the calibration of the sintered component. On the one hand in this way the set-up time of the compaction and calibrating press can be shortened, as a flush alignment of the die with the calibrating plate, as required in the prior art, is unnecessary. In this way on the other hand the precision of the component can also be increased. Due to the one-piece configuration of said die the latter can also be exposed to greater loads and errors can be avoided in the transition of the sintered component from the die to the calibrating plate, which can occur with the dies according to the prior art.

It is also possible that the sintered component after calibration is moved again against the pressing direction through the last of the die sections with decreasing inner diameters. In this way the precision of the sintered component can be increased further.

According to another embodiment variant of the method it is possible that the inner contour of the second last die section of the sequence of the die sections with decreasing inner diameters with respect to the geometric dimensions in the direction perpendicular to the pressing direction of the inner contour of the die sections corresponds with the intended contour with nominal dimensions. This embodiment variant is in particular an advantage if the sintered component is removed again via the first die opening, by means of which it is introduced into the die. It is thus achieved that the sintered component runs through a calibrating section three times during its production. The sintered component is firstly compacted in the said second last die section to obtain the nominal dimensions. In the following last die section with a decreasing inner diameter it is then compacted again before it reaches a calibrating section, where it is also relaxed in the latter at the same time. After the reversal of movement the sintered component runs back through the last die section and is calibrated again in the second last die section. In this way the precision of the component can be improved.

According to a further embodiment variant of the method it is possible that the sintered component comprises a first edge and a second edge which is opposite the latter in pressing direction, which are formed at transitions between an end face which can be placed against the die sections and axial end faces of the sintered component, and that the first and/or the second edge is/are faceted prior to insertion into the die. On the one hand, in this way the insertion of the sintered component into the die can be improved, as by means of the faceting there is less shearing on the edges of the sintered component. In this way the risk of breakage during the insertion of the sintered components into the die can be reduced. Furthermore, it could also be observed that with (approximately) cylindrical components, such as for example gears, the "cylinder geometry" can be improved, thus the sintered components also have a higher degree of precision. By means of this embodiment variant however it is also possible to counteract the formation of a ridge in the region of the edges. This in turn reduces the cost of producing the sintered component, as the subsequent removal of the ridge is simpler or can be omitted. Such ridges on sintered components can cause damage to additional (sintered) components adjoining the sintered components, in particular if the sintered components are intended for rotational movements. As well as these effects in this embodiment variant by reducing the wear at the edges the load-bearing part of the sintered component can be increased.

To improve these effects further according to one embodiment variant it is possible that the first edge, which during the surface compaction and calibration of the sintered component is arranged above the second edge, is faceted more than the second edge. In this way it is possible to provide more free space for the material displacement from underlying areas of the sintered component in pressing direction in the upper area of the sintered component in pressing direction.

For a better understanding of the invention the latter is explained in more detail with reference to the following Figures.

In a simplified, schematic representation respectively:

Figure 1:
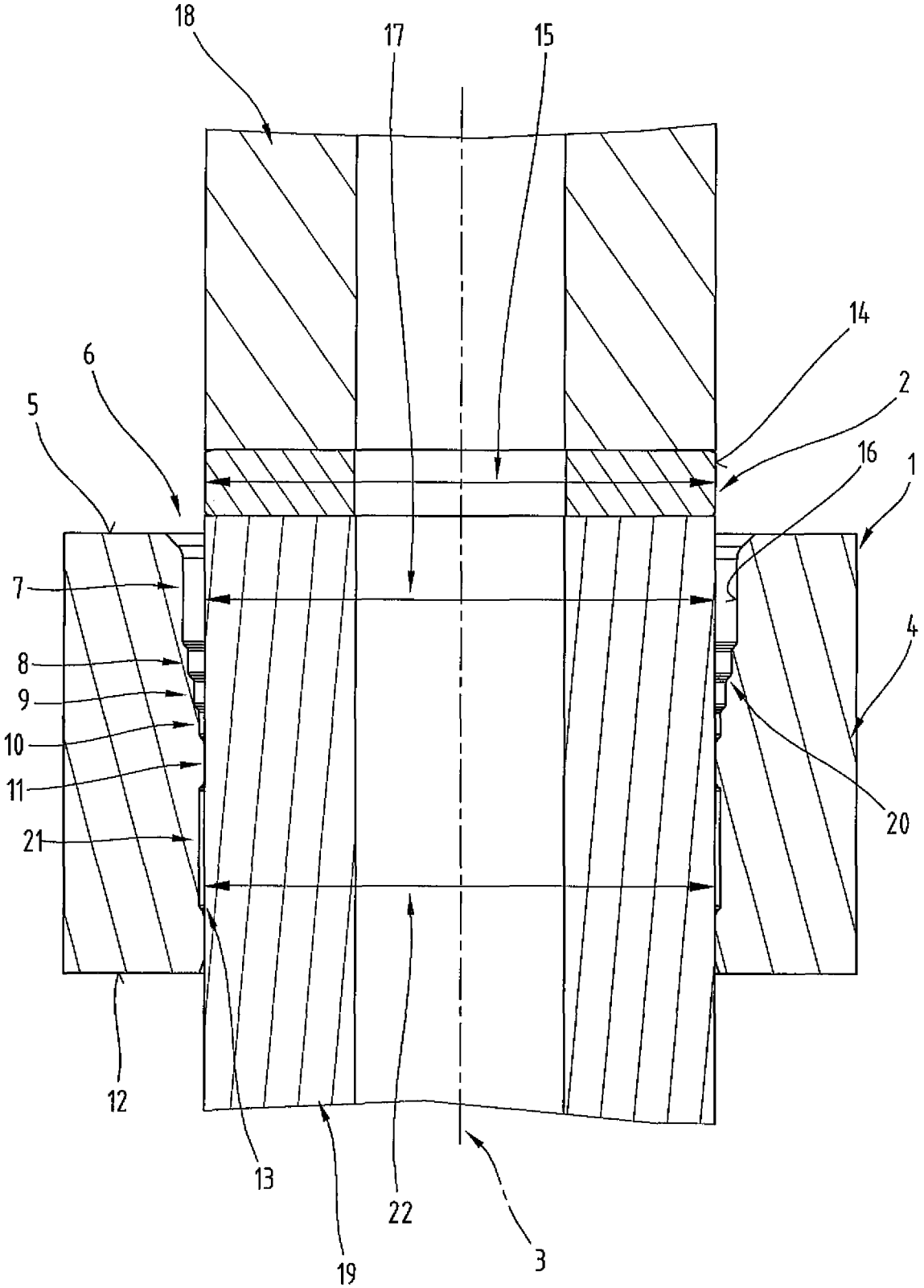
FIG. 1 is a cross-section of a section of a die with a sintered component shortly before the insertion.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

It should be noted at this point that the calibration of a sintered component means the processing of the latter to obtain at least approximately the nominal dimensions of the component in a die by pressure loading. The term "at least approximately" means that deviations from the nominal dimensions are permissible within the usual tolerance range.

The term nominal dimensions is defined in the present invention to mean the final dimensions that the finished sintered component 2 should have, possibly less the expansion of the sintered component 2 after the relaxation (i.e. the ejection out of the calibrating die, as explained in more detail below) which is defined by the spring back behavior of the sintered material due to the elastic spring-back. The amount of spring-back behavior can be determined empirically. In other words the nominal dimension plus the possible expansion caused by the elastic spring-back form the final dimensions.

Figure 2:
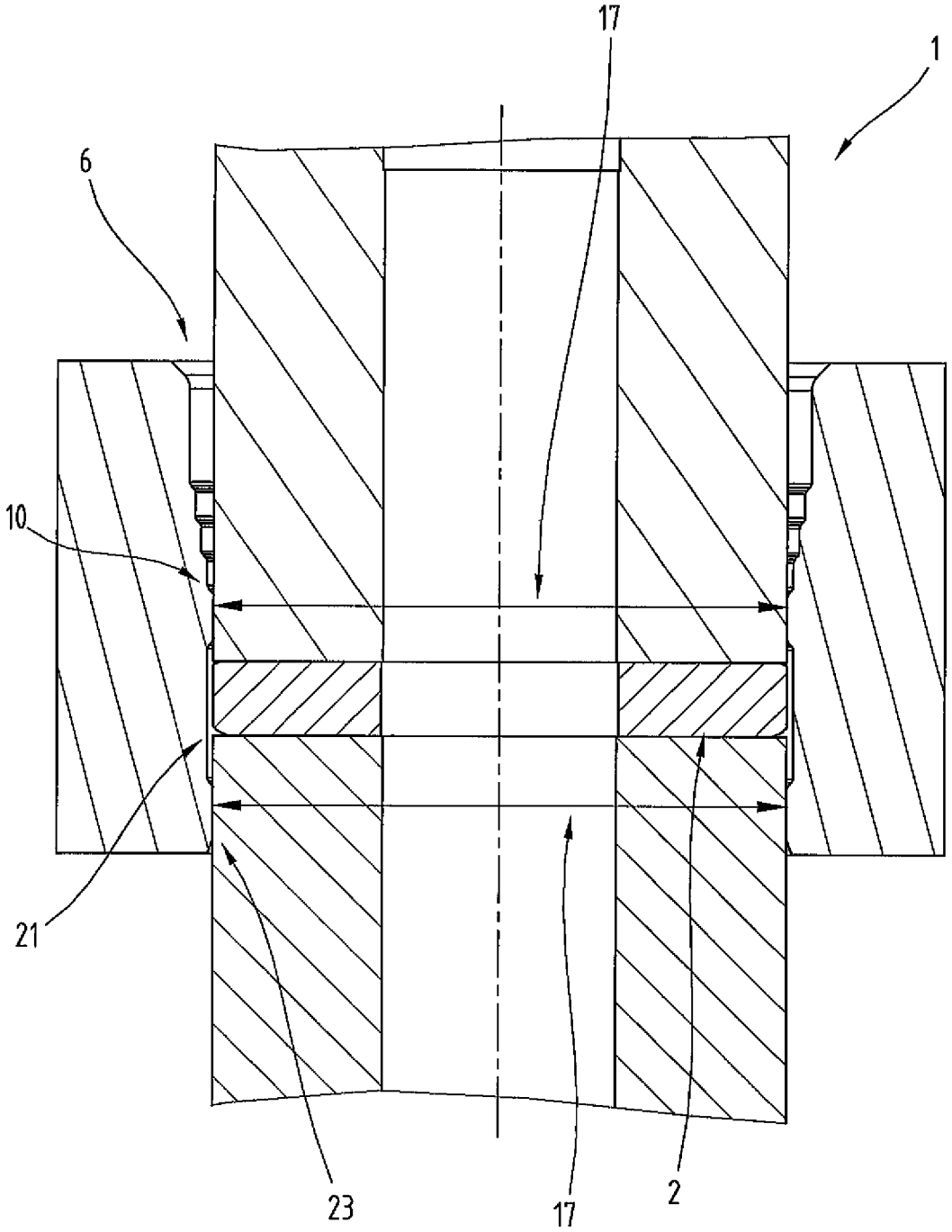
FIG. 2 is the cross section of the section of the die according to FIG. 1 with the sintered component in the calibration position.

FIGS. 1 and 2 show a section of a die 1 for the surface compaction and calibration of a sintered component 2 in longitudinal cross-section.

The sintered component 2 consists of pressed and subsequently sintered powder metal, wherein the methods and materials for producing such a sintered blank are sufficiently known from the prior art and are therefore not explained in more detail.

For the surface compaction and calibration the sintered component 2 is moved along an axis 3 through the die 1.

The die 1 comprises a main die body 4, which on one die surface 5 has a first (upper) die opening 6, from which a plurality of die sections 7 to 11 lead along the axis 3 into the inside of the main die body 4. In this case the first die section 7 adjoins the first die opening 6, the last die section 11 is however closer to a second die surface 12 lying opposite the first die surfaces 5 along the axis and a second die opening 13 formed therein.

The sintered component 2 is designed to be disc-like in the shown embodiment and has on a radial outer surface 14, i.e. the end face, a diameter 15, which prior to the surface compaction corresponds to a rough diameter and after the surface compaction corresponds to a smaller final diameter.

In general preferably rotationally symmetrical and/or at least approximately cylindrical sintered components 2, such as in particular gears, etc., are surface compacted and calibrated by the die 1. However, other sintered components 2 can also be processed accordingly by the die 1.

The surface compaction of the sintered component 2 is performed in that the latter is inserted through the first die opening 6 into the first die section 7 and is then moved into all of the additional die sections 8 to 11, wherein in each die section 7 to 11 the outer surface 14 of the sintered component 2 is pressed at least on sections of the outer surface 14 against wall faces 16 of the die sections 7 to 11. In this case one or more contact surfaces on the outer surface 14 of the sintered component 2 come into pressure contact with one or more pressing surfaces on the wall faces 16 of the die sections 7 to 11. The contact surface can be formed by a part of or the whole outer surface 14 of the sintered component 2. The pressing surface can be formed by a portion of the wall surface 16 or also by the whole wall surface 16, wherein the portion can relate to the axial extension and/or to the extension in circumferential direction.

The pressing effect is achieved in that an inner diameter 17 of the die sections 7 to 11, which is defined by the internal width between opposite or cooperating sections of the pressing surface of a die section 7 to 11, is smaller respectively than the diameter 15 of the sintered component 2 before it is inserted into the respective die section 7 to 11. In general, the die sections 7 to 11 preferably have an inner contour, which corresponds to the outer contour of the sintered component 2, whereby however each die section 7 to 11 has a circumference which is smaller than the circumference of the sintered component 2 before it is inserted into the respective die section 7 to 11.

The die sections 7 to 11 following one another along the axis 3 merge directly into one another (continuously), i.e. without intermediate sections, and have decreasing inner diameters 17 from the first die section 7 to the last die section 11 (monotonically), i.e. consecutive die sections 7 to 11 can be the same size or in particular can be smaller, but not larger. In this way the pressing effect on the contact surface of the sintered component 2 increases from the first die section 7 to the last die section 11, whereby a pressing direction is defined along the axis 3, which points from the first die section 7 to the last die section 11. The movement of the sintered component 2 in the die 1 is preferably linear in said pressing direction from the first die opening 6 to the last die section 11, afterwards the sintered component 2 is demolded from the die 1, preferably after a reversal of the direction of movement opposite the pressing direction through the first die opening 6.

The linear movement in the direction of the axis 3 can also be overlayered by a rotational movement, whereby the sintered component 2 in the die 1 performs a screwing movement.

By means of the press fit which is effective between the said contact surfaces and the said pressing surfaces, compressive stresses occur which are oriented essentially perpendicular to the contact surfaces. Said stresses acting on the contact surfaces in the sintered component 2 cause both an elastic and also a plastic deformation of the sintered component 2, wherein the plastic portion causes the remaining surface compaction. With this surface compaction the powder metal particles joined by the pressing and subsequent sintering on so-called bridges are pushed against one another strongly and deformed plastically. The pore-like cavities between the powder metal particles after sintering are thereby reduced in volume and the material density is increased in this area.

The effect of the surface compaction is greatest directly on the contact surface and decreases in the direction on the inside of the sintered component 2. By means of the method typically edge layers of sintered components 2 with a thickness of several hundredths of a millimeter to several tenths of a millimeter and above are compacted.

The relative movement required for performing the method between the sintered component 2 and the die 1 can be performed by moving the sintered component 2 and/or by moving the die 1, whereby the sintered component 2 and the die 1 for this are each connected to a suitable drive or a fixed frame part. During the surface compaction and the subsequent calibration the sintered component 2 is clamped between an upper punch 18 and a lower punch 19. For the downwards movement the upper punch 18 pushed from above onto the sintered component 2, the lower punch 19 thereby is pulled downwards or it is also pushed downwards by the upper punch 18. For the preferred ejection of the sintered components 2 via the first die opening 6 the lower punch 19 is pushed upwards and if necessary the upper punch 18 can be pulled upwards. For said movements of the upper punch 18 and the lower punch 19 corresponding, but not shown, drives are provided.

The transition from one die section 7 to 10 to the adjoining die section 8 to 11 can be in the form of chamfering 20, or provided with a rounding, wherein in pressing direction a convex rounding can adjoin a concave rounding. In this way there can be gentle transition of the sintered component 2 from one die section 7 to 10 to the next die section 8 to 11, without there being an intentional removal of material from the sintered component 2 caused by a sharp-edged step or, that the edges at transitions of the die 1 break off. As shown in FIGS. 1 and 2, such a chamfering can also be formed on the first die opening 6. The chamfering 20 or the respective roundings are part of the respective die section 7 to 11, and thus do not form an intermediate section.

Although in the embodiment variant of the die 1 shown specifically in FIGS. 1 and 2 five die sections 7 to 11 are shown, the die 1 can generally have between three and eight or more than eight such die sections.

As this embodiment of the die 1 is known in principle from the aforementioned EP 2 066 468 A2, reference is made to the latter for further details. EP 2 066 468 A2 belongs in this respect concerning the surface compaction to the present description.

The last die section 11 shown in FIG. 1 is the section of the die 1, which has the smallest inner diameter 17 or the smallest internal width. Directly adjoining said last die section 11 with the smallest inner diameter 17 in the die 1 a relief section 21 is provided or formed. Said relief section 21 has a larger inner diameter 22 compared to the last die section 11 immediately in front of it with a decreasing inner diameter 17. In this way the sintered component 2 can relax in this relief section 21. At the same time as this relaxation in the relief section 21 the calibration of the sintered component 2 is also performed. In addition the relief section 21 has an inner contour which corresponds to the intended contour with nominal dimensions of the sintered component 2. The inner contour of the relief section 21 is with respect to both the geometry and the geometric dimensions (as viewed in cross-section) the same as the external contour of the finished sintered component 2. Said calibration of the sintered component 2 is shown in FIG. 2.

Adjoining the relief section 21 the die 1 has a further section 23. Said section 23 has an inner diameter 17 or an internal width, which corresponds to the inner diameter 17 or the internal width of the last die section 11 with the smallest inner diameter 17. The section 23 is used for guiding the lower punch 19 in the die 1.

The inner diameter 22 or the internal width of the relief section 21 corresponds to the outer diameter 15 (FIG. 1) or the internal width of the finished sintered component 2. Said inner diameter 22 or said internal width of the relief section 21 is greater by at least 0.02%, in particular between 0.02% and 0.1%, than the inner diameter 17 or the internal width of the last die section 11 with the smallest inner diameter 17. However, the inner diameter 22 or the internal width of the relief section 21 is not greater than the inner diameter or the internal width of the first die opening 6. In this way it is possible to achieve the at least approximately complete relaxation of the sintered component 2.

As shown in FIGS. 1 and 2, the used die 1 is preferably designed in one piece so that the latter also comprises the relief section 21. However, it is also possible that at least the relief section is formed by a separate, independent, in particular plate-like die, which is arranged for performing the method for surface compaction and calibration of the sintered component 2 directly adjoining the die 1.

According to one embodiment variant of the method for the surface compaction and calibration of the sintered component 2, it is possible that the inner contour of the second to last die section 10 of the sequence of die sections 7 to 11 with decreasing inner diameters 17 with respect to the geometric dimensions in a direction perpendicular to the pressing direction of the inner contour of the relief section 21 corresponds with the intended contour comprising the nominal dimensions. In other words, said second last die section 10 as viewed in cross-section can be designed to be identical to the cross-section of the relief section 21 and thus to the calibration cross-section both with respect to the geometry and also the geometric dimensions in cross-section.

Figure 3:
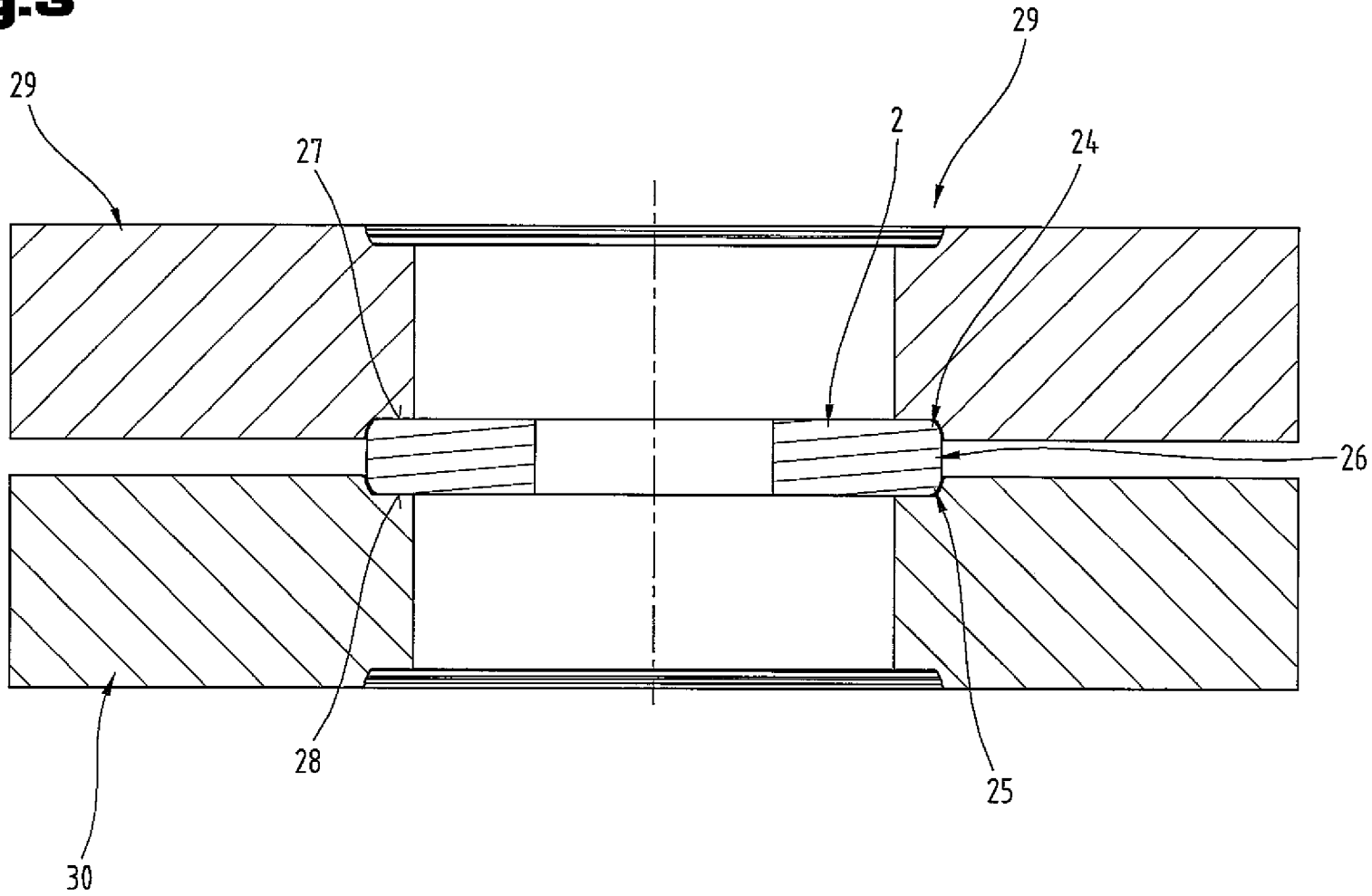
FIG. 3 is a cross-section of a die for faceting the sintered component.

According to a further embodiment variant of the method, it is possible that the sintered component 2 has a first edge 24 and a second edge 25 opposite the latter in pressing direction (as is usual), which are formed at transitions between an end face 26 applicable to the die sections and axial end surfaces 27, 28 of the sintered component, and that the first and/or the second edge is/are faceted prior to insertion into the die. In FIG. 3 in addition a press die 29 is shown in longitudinal cross-section, by means of which such faceting can be produced by pressing.

The press die comprises a first lower press part 30 and a second upper press part 31. The first and the second press parts 30, 31 comprise corresponding negative facets at the corresponding points at which the edges 24 or 25 of the sintered component 2 come to rest. The sintered component 2 is clamped after sintering between the first and the second press part 30, 31. By pushing together said two press parts 30, 31 by a predeterminable distance the sintered part 2 is given the faceting by material displacement.

Figure 4:
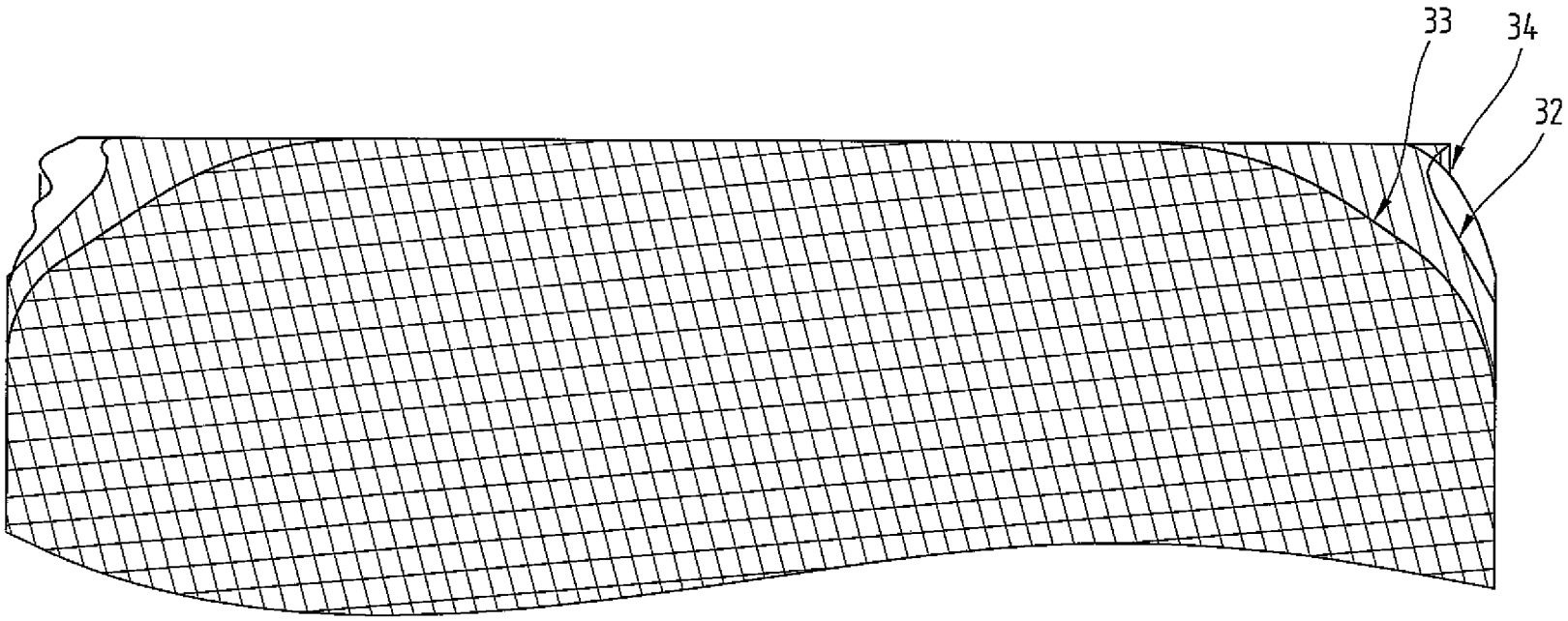
FIG. 4 is a schematic comparison of the state of the sintered component after the sintering, after the faceting and after the surface compaction and calibration.

FIG. 4 shows a schematic state diagram of the sintered component 2. A line 32 shows the state of the edge after sintering, line 33 shows the state of the edge after processing in the press die 29 and line 34 shows the state of the edge after the surface compaction and calibration of the sintered component 2 in the die 1 (FIG. 1).

The faceting of the edges 24, 25 of the sintered component 2 is in particular in the form of a rounding, as shown in FIG. 4. The largest rounding radius—the facets can have a rounding radius which varies along its profile, as shown in FIG. 4, can be selected from a range of 0.1 mm to 5 mm.

In principle, the first, upper edge 24 and the second, lower edge 25 of the sintered components 2 can be provided with the same facets. However, according to one embodiment variant preferably the first edge 24, which is arranged during the surface compaction and calibration of the sintered component 2 above the second edge 25, is more faceted (i.e. has a facet with a larger surface area), than the second edge 25.

The method for the surface compaction and calibration of the sintered component 2 can also be used for the surface compaction and calibration of openings such as e.g. bores, in sintered components 2. Instead of the die 1 a punch is used which like the die 1 also comprises sections with different diameters and the corresponding calibrating section in the relaxation stage, where in this case however the diameter of the sections merging into one another increases (monotonically). All further explanations relating to the die 1 also relate analogously to the punch, wherein the details "inner" and "outer" need to be changed accordingly.

The example embodiments show possible embodiment variants of the die 1 and/or the press die 29.

Lastly, for the sake of formality it should be noted that for a better understanding of the structure of the die 1 and/or the press die 29 the latter has not been shown to scale in part and/or has been enlarged and/or reduced in size.

LIST OF REFERENCE NUMERALS

1 die
2 sintered component
3 axis
4 main die body
5 die surface
6 die opening
7 die section
8 die section
9 die section
10 die section
11 die section
12 die surface
13 die opening
14 outer surface
15 diameter
16 wall faces
17 inner diameter
18 upper punch
19 lower punch
20 chamfering
21 relief section
22 inner diameter
23 section
24 edge
25 edge
26 end face
27 end surface
28 end surface
29 press die
30 press part
31 press part
32 line
33 line
34 line

The invention claimed is:

1. A method for the surface compaction and calibration of a sintered component, according to which the sintered component is moved along an axis from a first die opening in the direction of a second die opening of a die opposite the first die opening along the axis, wherein the sintered component during this movement passes through a plurality of die sections of the die and in this way a surface area of the sintered component is compacted, whereby in a pressing direction an inner diameter of the consecutive die sections decreases and the individual die sections are arranged such that a following die section of the plurality of die sections respectively directly adjoins the corresponding die section which precedes it in the pressing direction, and after the surface compaction at the last die section with decreasing inner diameter there is a relaxation of the sintered component in a relief section directly adjoining the last die section, wherein the relief section has a greater diameter than the immediately preceding last die section of the die section with a decreasing inner diameter, wherein the sintered component is calibrated in the relief section, whereby an inner contour of said relief section corresponds with an intended contour with nominal dimensions of the sintered component, wherein the relief section has an inner diameter which is greater by at least 0.02% than the inner diameter of the last die section with the smallest inner diameter and is not greater than the inner diameter of the first die opening, wherein the sintered component comprises a first edge and a second edge opposite the first edge in the pressing direction, which are formed at transitions between an end face applicable against the die sections and axial end surfaces of the sintered component, and wherein the first edge and the second edge of the sintered component are faceted before being introduced into the die.

2. The method as claimed in claim 1, wherein a die is used in which the relief section is formed.

3. The method as claimed in claim 1, wherein after calibration the sintered component is moved against the pressing direction again through the last die section with a decreasing inner diameter.

4. The method according to claim 1, wherein an inner contour of a second last die section of the plurality of die sections corresponds with the inner contour of the relief section.

5. The method as claimed in claim 1, wherein the first edge, which is arranged during the surface compaction and calibration of the sintered component above the second edge, is faceted to a greater degree than the second edge.

6. The method as claimed in claim 1, wherein the inner diameter of the relief section is not greater than a diameter of the first die section.

* * * * *